US006326876B1

(12) United States Patent
Yeh et al.

(10) Patent No.: US 6,326,876 B1
(45) **Date of Patent: *Dec. 4, 2001**

(54) BOBBIN AND ITS PRODUCING METHOD

(75) Inventors: Ming Yeh; Allen Chou; Antony Du, all of Taoyuan Shien (TW)

(73) Assignee: Delta Electronics Inc. (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/235,999

(22) Filed: Jan. 22, 1999

(30) Foreign Application Priority Data

Jul. 9, 1998 (TW) ..... 87211074

(51) Int. Cl.[7] ..... H01F 27/30
(52) U.S. Cl. ..... 336/198; 336/192
(58) Field of Search ..... 336/192, 212, 336/196, 197, 198, 199; 242/118.7, 437.2; 331/219; 29/605, 883

(56) References Cited

U.S. PATENT DOCUMENTS

| | | | | |
|---|---|---|---|---|
| 3,679,998 | * | 7/1972 | Dahlinger | 315/57 |
| 4,146,857 | * | 3/1979 | Schleupen | 336/61 |
| 4,165,055 | * | 8/1979 | Dee | 242/125.2 |
| 4,621,503 | * | 11/1986 | Woods et al. | 62/228.3 |
| 4,723,731 | * | 2/1988 | Posso | 242/197 |
| 5,967,816 | * | 10/1999 | Sampa et al. | 439/190 |
| 5,982,263 | * | 11/1999 | Bouillot et al. | 336/185 |

* cited by examiner

*Primary Examiner*—Lincoln Donovan
(74) *Attorney, Agent, or Firm*—Greer, Burns & Crain, Ltd.

(57) ABSTRACT

A bobbin for reeling thereon a plurality of threads and its producing method are provided. The bobbin includes a cylinder, a plurality of sleeves setting on the cylinder wherein the cylinder and the sleeves are made of different materials, and a plurality of pins inserting in the sleeves for holding the plurality of threads thereon.

8 Claims, 6 Drawing Sheets

BOBBIN AND ITS PRODUCING METHOD

FIELD OF THE INVENTION

The present invention relates to a bobbin and its producing method, wherein the bobbin is used for reeling thereon a plurality of threads.

BACKGROUND OF THE INVENTION

The material for manufacturing the bobbin body can be divided into two groups, the thermoplastic material and the thermosetting material. The thermoplastic material is a linear polymer which has a higher flexibility and a higher strength but has a poor heat resistance in comparison with the thermosetting material. The strength of the thermoplastic material is lowered as the ambient temperature is increased. The cost for increasing the heat resistance of the thermoplastic material is high and uneconomic.

The conventional bobbins 10, 20 are shown in FIG. 1 and FIG. 2. The whole bodies of bobbins 10, 20 are made of a thermoplastic or a thermosetting material by one time of injection molding. The thermoplastic material is the most popular material for producing a bobbin because it has a better mechanical property and a lower price. However, the thermoplastic material has a poor heat-resistance and there is a lot of heat conducting from the pins to the bobbin body when the soldered threads are held on the pins so that the bobbin body cracks and the pins fall off.

The thermosetting material has a higher heat resistance because of its network molecular structure. When the bobbin body is made of the thermosetting material, it can sustain the heat conducting from the pins. However, the strength of the thermosetting material is poor. The bobbin body made of the thermosetting material is very easily to crack when it rotates at high speed for reeling thereon threads.

The main purpose of the present invention is to produce a bobbin which can combine both of the advantages of the thermoplastic and thermosetting materials. The bobbin according to the present invention is economic and practical.

SUMMARY OF THE INVENTION

An object of the present invention is to provide a bobbin for reeling thereon a plurality of threads. The bobbin includes a cylinder, a plurality of sleeves setting on the cylinder wherein the cylinder and the sleeves are made of different materials, and a plurality of pins inserting in the sleeves for holding the plurality of threads thereon.

In accordance with the present invention, the cylinder further includes a base for setting the plurality of sleeves thereon and the plurality of sleeves are set on the base by mold-inserting or embedding. Besides, the cylinder further includes a plurality of blades mounted at spaces for reeling the threads. The spaces between blades can be unequal. Each blade includes a plurality of zigzags on one end of the blade, and the zigzags of one blade are positioned in a direction opposite to those of neighboring blades. Preferably, the cylinder is made of a thermoplastic material. The plurality of pins hold the plurality of threads by soldering and the plurality of sleeves are made of a heatproof material. The heatproof material is a thermosetting material such as bakelite.

Another object of the present invention is to provide a method for producing a bobbin for reeling thereon a plurality of threads. The method includes (a) setting a plurality of pins, (b) forming a plurality of sleeves made of a heatproof material wherein the plurality of pins are set in the center of the plurality of sleeves, and (c) forming a cylinder made of a thermoplastic material wherein the plurality of sleeves are set on the cylinder.

In accordance with one aspect of the present invention, the plurality of sleeves are formed by a first time of injection molding and the cylinder is formed by a second time of injection molding.

The present invention may best be understood through the following description with reference to the accompanying drawings, in which:

DETAILED DESCRIPTION OF THE PREFERRED EMBODIMENTS

Figure 1:
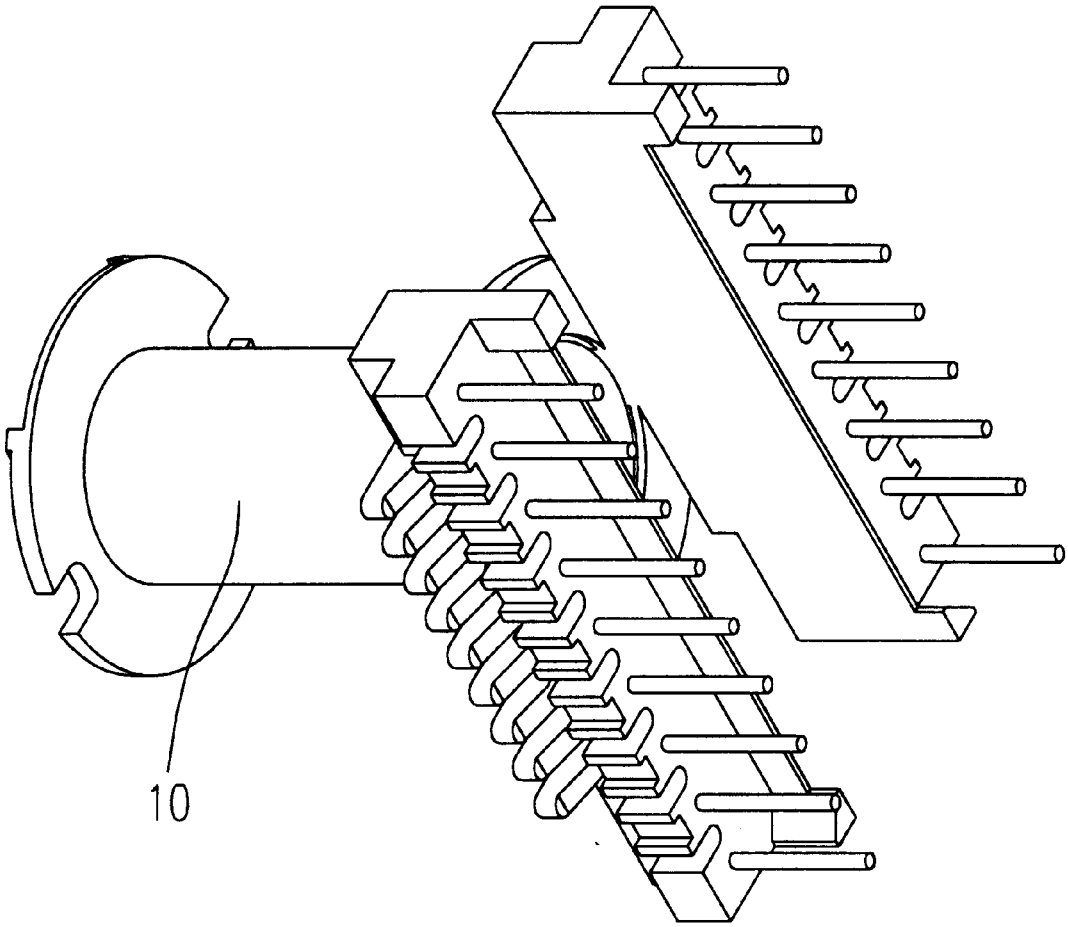
Fig. 1(PRIOR ART)
FIG. 1 and FIG. 2 schematically show two conventional bobbins.
Figure 2:
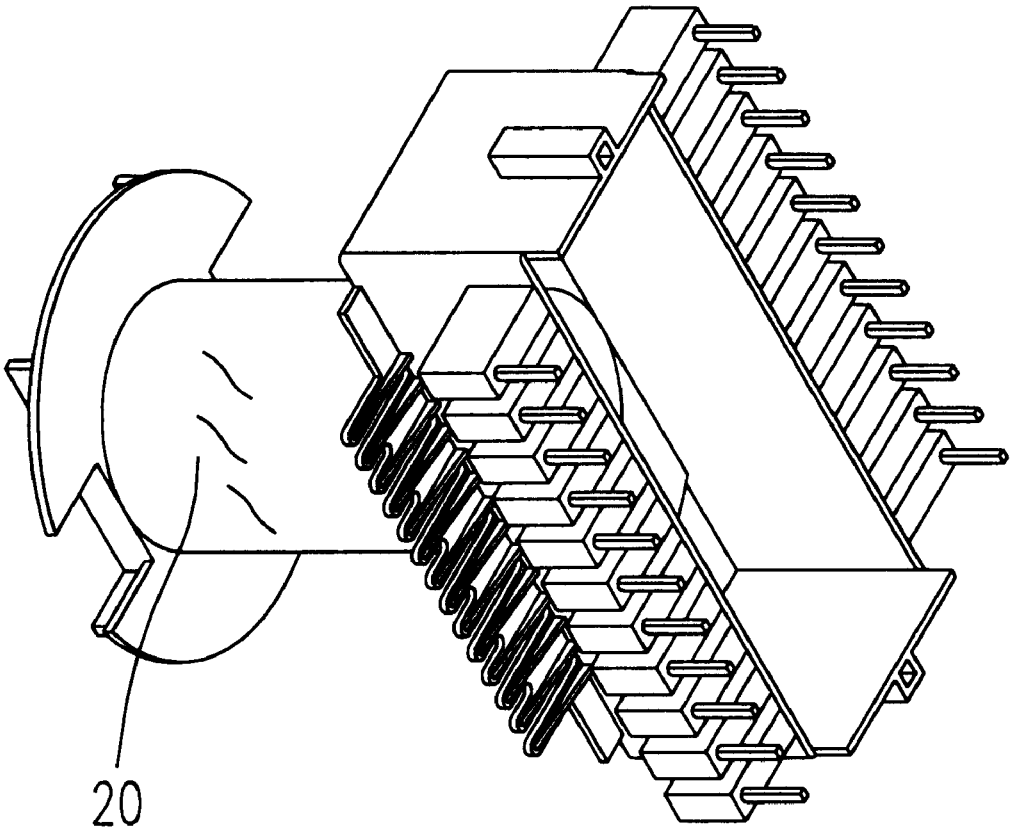
Fig. 2(PRIOR ART)
Figure 3:
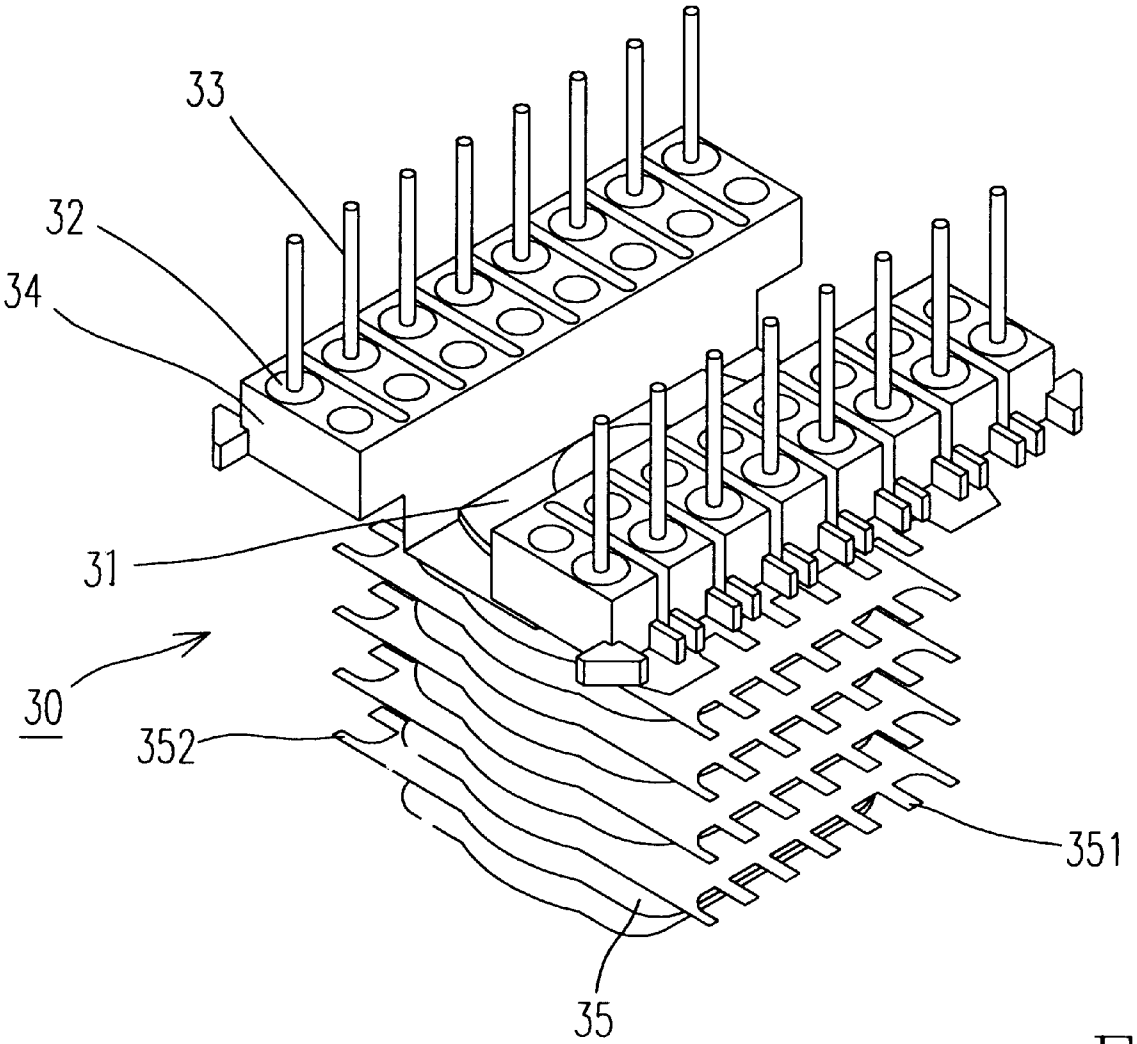
FIG. 3 schematically shows a preferred embodiment of a bobbin according to the present invention.

Please refer to FIG. 3 schematically showing a preferred embodiment of a bobbin according to the present invention. The bobbin 30 includes a cylinder 31, a plurality of pins 33, and a plurality of sleeves 32. The sleeves 32 are set for holding the pins and are made of a heatproof material, especially the thermosetting material such as bakelite. The thermosetting material can sustain the heat conducting from the pins 33 when soldering threads thereon. The cylinder 31 is made of the thermoplastic material. The thermoplastic has high flexibility and strength to sustain the stress while reeling. In addition, it is cheap and recyclable.

The cylinder 31 further includes a base 34 for setting the sleeves 32 and pins 33 thereon, and a plurality of blades 35 mounted at spaces for advantageously reeling the threads. The spaces between blades can be equal or unequal, depending on the manufacturer's needs. The sleeves 32 are set on the base 34 by mold-inserting or embedding. Each blade has a row of zigzags 351, 352 at one end of the blade. The neighboring blades have zigzags 351, 352 at the opposite end.

Because the sleeves 32 are made of the thermosetting material or bakelite, the sleeves 32 can sustain the heat conducting from the pins 33 when the threads are soldered thereon. Therefore, the cylinder 31 made of the thermoplastic material can be cool. The cylinder 31 made of the thermoplastic material can sustain the stress and vibration when reeling. This kind of bobbin combines both of the advantages of the thermoplastic and thermosetting materials to have a high flexibility body and also heatproof sleeves.

Figure 4:
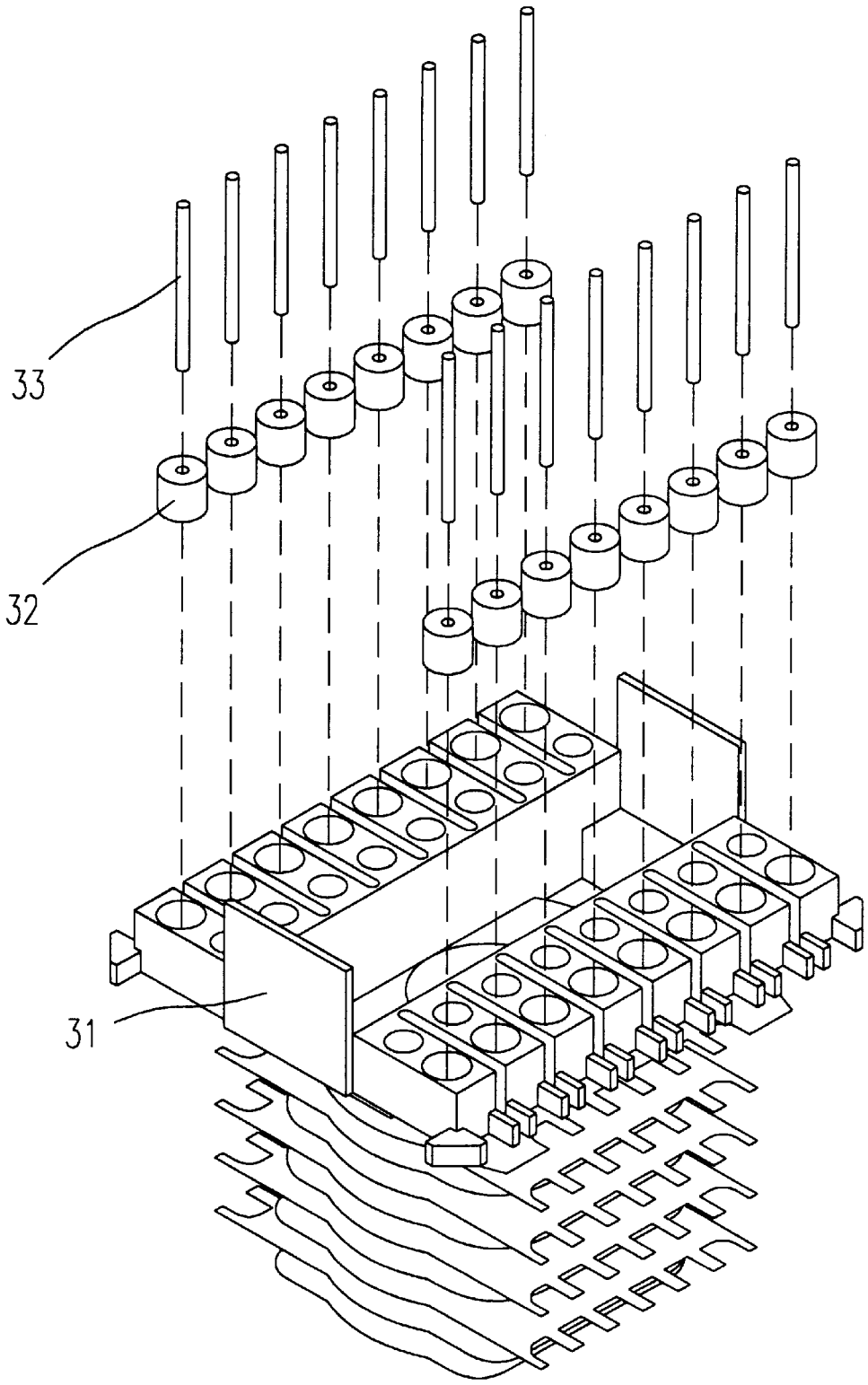
FIG. 4 is an exploded diagram showing the components of the bobbin according to FIG. 3.

Please refer to FIG. 4 schematically showing how the components of the bobbin are assembled. The process for producing the bobbin according to the present invention can be easily practiced by two times of injection moldings. First of all, the pins 33 is set inside a mold. The sleeves 32 is formed by a first time of injection molding. Then, the cylinder 31 is formed by a second time of injection molding. The sleeves 32 are set inside the cylinder 31 by mold-inserting or embedding.

Figure 6:
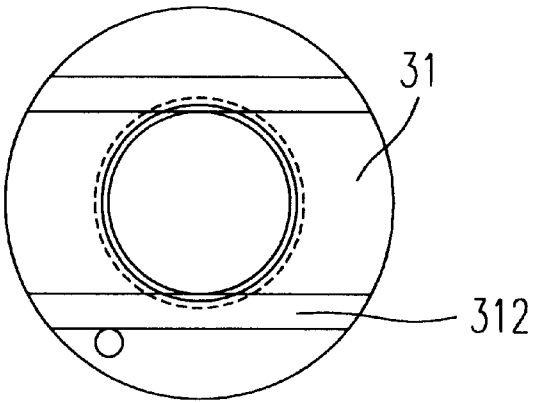
FIG. 6 is a bottom view of the bobbin according to FIG. 5.
Figure 5:
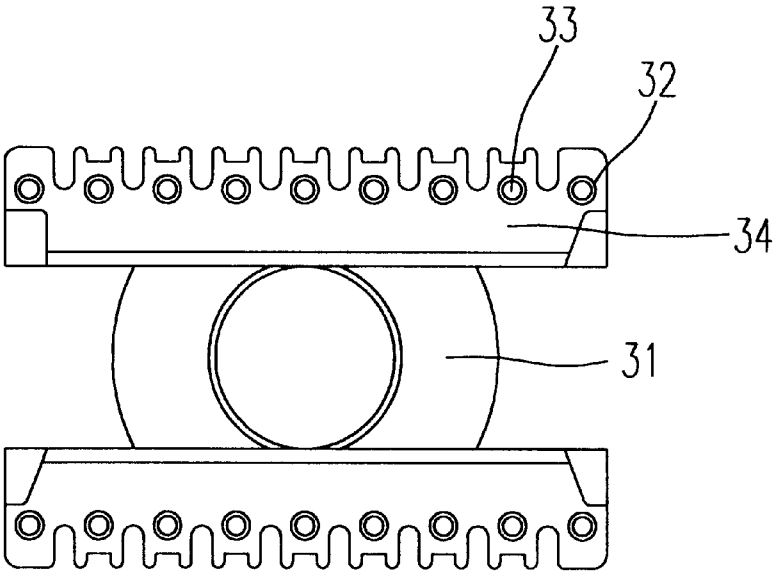
FIG. 5 is a top view of another preferred embodiment of a bobbin according to the present invention.
Figure 8:
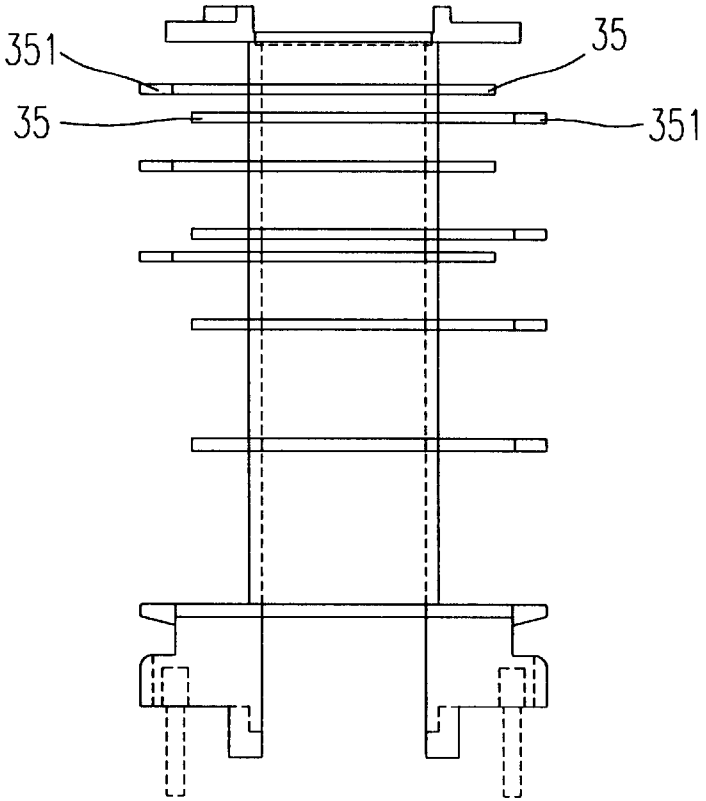
FIG. 7 and FIG. 8 are sectional views of the bobbin according to FIG. 5.
Figure 7:
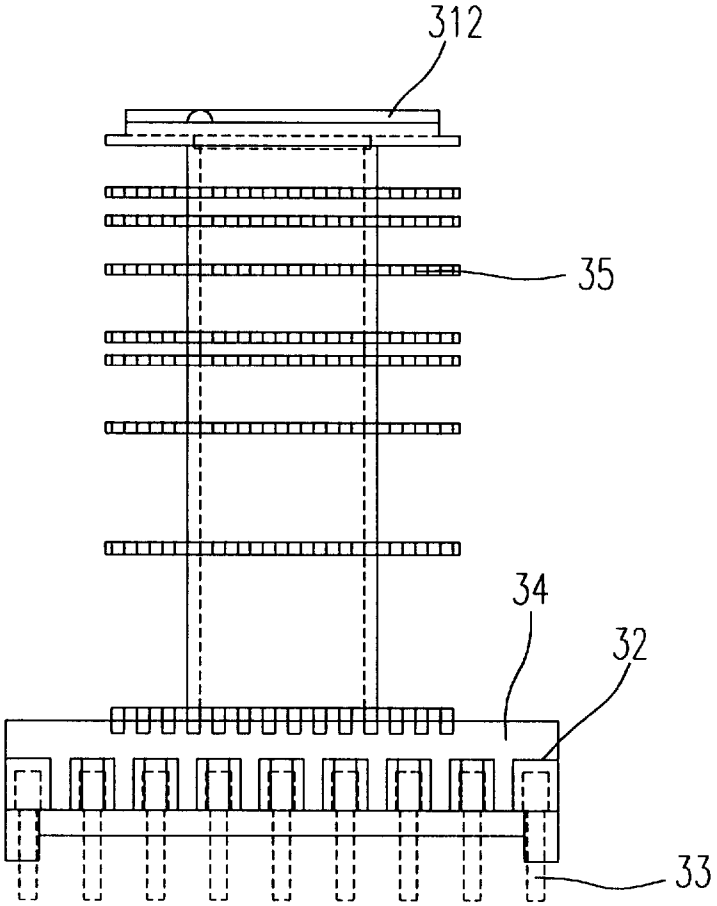

FIGS. 5–8 schematically shows another preferred embodiment of the bobbin according to the present invention. In FIG. 6, the bobbin includes a flange 312 on the bottom of the cylinder 31. In FIG. 7, the spaces between the blades 35 are not equal. Besides, the zigzags 351 of one blade 35 are positioned in a direction opposite to those of the neighboring blades as shown in FIG. 8.

The bobbin according to the present invention is very practical and useful. The bobbin is made of those two materials in order to combine their advantages, and the process for producing the bobbin can be easily accomplished. The bobbin according to the present invention can effectively reduce the defects of the conventional bobbins.

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A bobbin for winding a plurality of threads, thereon comprising:

a cylinder made of a thermoplastic material and used for winding said plurality of threads thereon;

a base connected to one end of said cylinder;

a plurality of sleeves mounted within said base and made of a heatproof material; and a plurality of pins disposed in said plurality of sleeves for holding said plurality of threads thereon;

wherein said sleeves are capable of sustaining the heat conducting from said pins to prevent said pins from falling off when said threads are soldered thereon.

2. The bobbin according to claim 1 wherein said cylinder further comprises a plurality of blades disposed on the peripheral surface thereof and separated with a space to each other for helping to reel said threads.

3. The bobbin according to claim 2 wherein each blade comprises a plurality of zigzags formed on one end thereof.

4. The bobbin according to claim 3 wherein said zigzags of any two neighboring blades are arranged in opposite directions.

5. The bobbin according to claim 2 wherein said spaces between any two neighboring blades are unequal.

6. The bobbin according to claim 1 wherein said plurality of pins hold said plurality of threads by soldering.

7. The bobbin according to claim 1 wherein said heatproof material is a thermosetting material.

8. The bobbin according to claim 7 wherein said thermosetting material is bakelite.

* * * * *